United States Patent [19]

Wilson et al.

[11] Patent Number: 4,765,044

[45] Date of Patent: Aug. 23, 1988

[54] SEMIAUTOMATIC TERMINATION APPARATUS FOR RIBBON CABLE

[75] Inventors: Michael C. Wilson, Oberlin; Robert Volinskie, Hershey, both of Pa.

[73] Assignee: AMP Incorporated, Harrisburg, Pa.

[21] Appl. No.: 910,049

[22] Filed: Sep. 19, 1986

[51] Int. Cl.[4] ..... H01R 43/04

[52] U.S. Cl. ..... 29/33 M; 29/564.4; 29/566.2; 29/749; 140/105

[58] Field of Search ..... 29/564.1, 564.4, 564.6, 29/564.7, 564.8, 566.2, 749, 753, 748, 751, 857, 861, 866, 566.1, 566.3, 33 F, 752, 33 M; 72/326; 140/105

[56] References Cited

U.S. PATENT DOCUMENTS

| | | | |
|---|---|---|---|
| 3,147,779 | 9/1964 | Brown | 140/105 X |
| 3,909,900 | 10/1975 | Gudnestad | 29/564.4 |
| 4,040,167 | 8/1977 | Jepson et al. | 29/564.4 |
| 4,139,937 | 2/1979 | L'Homme | 29/748 X |
| 4,153,082 | 5/1979 | Foley | 140/105 |
| 4,351,110 | 9/1982 | Folk | 29/753 X |
| 4,516,309 | 5/1985 | Clark | 29/564.4 |
| 4,521,960 | 6/1985 | Maack et al. | 29/861 X |
| 4,590,660 | 5/1986 | Starski | 29/566.3 |

FOREIGN PATENT DOCUMENTS

| | | | |
|---|---|---|---|
| 0147080 | 3/1985 | European Pat. Off. . | |
| 2,158,254 | 6/1973 | Fed. Rep. of Germany | 29/752 |
| 2283568 | 3/1976 | France . | |

*Primary Examiner*—Z. R. Bilinsky

*Attorney, Agent, or Firm*—Bruce J. Wolstoncroft

[57] ABSTRACT

Apparatus for semiautomatic termination of conductors of a ribbon cable to electrical terminals of an electrical connector having conductor receiving cavities located on opposite sides thereof. In operation the apparatus combs and shears individual conductors of the ribbon cable. The comb means cooperates with the individual conductors adjacent the dielectric jacket of the cable, ensuring that the individual conductors will be combed and spaced as required for termination to the terminals. The shear means is retracted, leaving the comb means in contact with the conductors, maintaining the position of the conductors until the connector is brought into place. A shuttle then places the connector in engagement with the conductors. The comb means is retracted, permitting the conductors to be positioned in alignment with terminating sections of the terminals which in turn allows for insertion and crimping of the conductors to occur. A unique feature of this assembly is that as the conductors are sheared, they are also preformed to enable the connector to be easily inserted along the preformed conductors.

18 Claims, 10 Drawing Sheets

Fig. 2
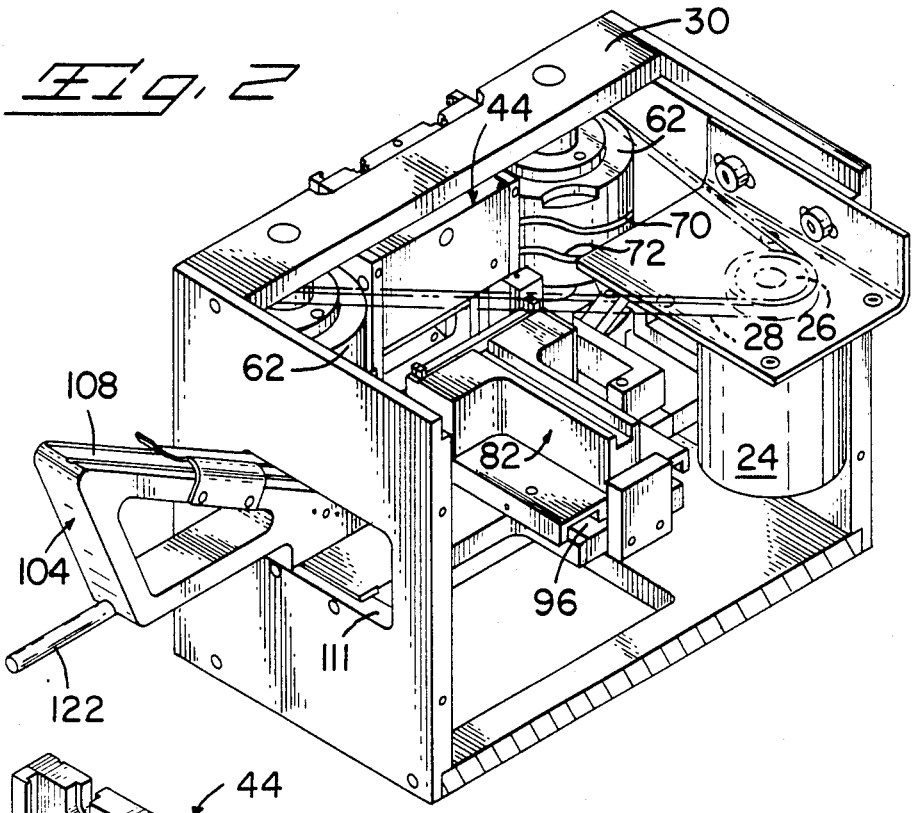
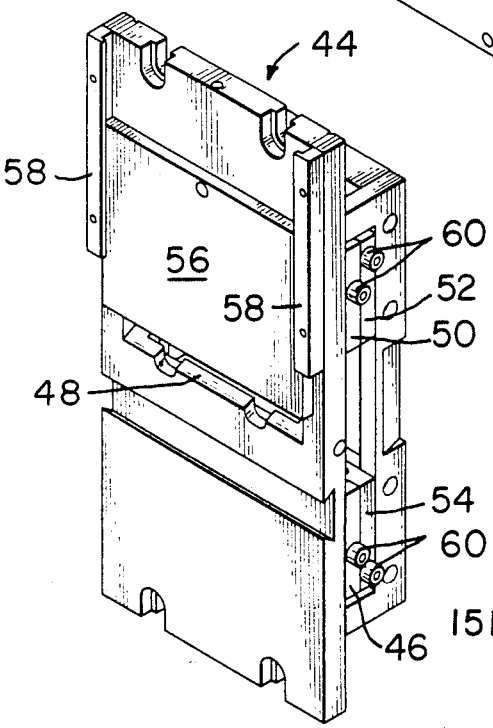
Fig. 6
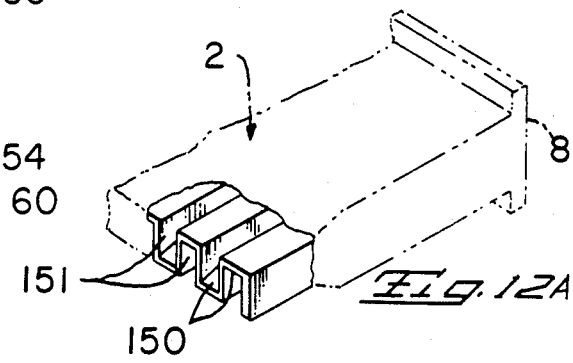
Fig. 12A

SEMIAUTOMATIC TERMINATION APPARATUS FOR RIBBON CABLE

FIELD OF THE INVENTION

The invention relates to an apparatus for connecting a ribbon cable to an electrical connector and more particularly to simultaneously connecting each of a plurality of conductors of the cable to individual terminals spaced on either side of an electrical connector.

BACKGROUND OF THE INVENTION

Numerous different types of assemblies are available for termination of ribbon cable to a multicontact electrical connector. Many of these are commonly known and used in the industry.

A majority of these assemblies are intended to secure the connectors to the cable in the same orientation relative thereto, i.e. with the terminals of the connectors all projecting from the same side of the connector. It is difficult for these assemblies to terminate respective individual conductors of the ribbon cable to terminals located on either side of a connector.

Another problem with many of the present assemblies is that they are incapable of terminating conductors of the ribbon coaxial cable to terminals of a connector which has a different center linespacing than that of the conductors.

Assemblies have attempted to terminate a ribbon cable onto a connector having terminals on opposing sides, with the results being less than spectacular. Problems with termination of the individual conductors onto the terminals has been a major problem, causing inconsistent and inadequate results. It is therefore desirable to have an assembly which automatically and simultaneously terminates individual conductors to electrical terminals on opposite sides of the connector, but also to have an assembly which operates in such a manner so as to be reliable thereby resulting in dependable terminations.

SUMMARY OF THE INVENTION

In accordance with the present invention, an apparatus for the production of electrical harnesses is disclosed. Each harness produced comprises an electrical connector mechanically and electrically connected to lengths of flat cable. The individual conductors of the cable are connected to terminals on the corresponding side of the connector.

The apparatus is provided with a frame to which other subassemblies are attached. A clamp is positioned on the front of the apparatus, the clamp securing the ribbon cable in position such that the operation of the apparatus will proceed as desired. A connector feed station, positioned on the side of the apparatus and protruding outside of the frame, is also provided to load the appropriate connector into the apparatus so that the apparatus may function in a semiautomatic mode.

The feed station loads the connector into a shuttle which moves the connector between a back position and a front position. The shuttle also houses the insertion and crimp tooling, the tooling positioned on either side of the connector. Spring means provided on the shuttle cooperate with the insertion-crimp tooling to ensure the insertion-crimp tooling is in an open position when required.

Comb, support, and shear tooling is provided adjacent the clamp, the tooling cooperating with the conductors of the ribbon cable to perform the required spacing, shearing, forming, and terminating functions thereon. The tooling also cooperates with the shuttle to enable the insertion-crimp tooling to perform their respective functions.

Drive means move the various parts of the apparatus. The drive means acts as a timing means to ensure that the various functions are performed at the exact time at which they are to be performed.

It is an object of the present invention to provide an apparatus which terminates individual conductors of a ribbon cable to electrical terminals on opposite sides of a connector.

It is a further object of the present invention to provide a means for ensuring that the individual conductors cooperate with the connector in such a way as to prevent the individual conductors from being deformed as the electrical terminals of the connector are brought into engagement with the individual conductors, resulting in a reliable connection between the terminals of the connector and the respective conductors.

BRIEF DESCRIPTION OF THE DRAWINGS

FIG. 6 is a perspective view of the comb-shear subassembly of the present invention.

FIG. **12*a*** is a fragmentary perspective view of a loading zone of the connector.

Figure 9:
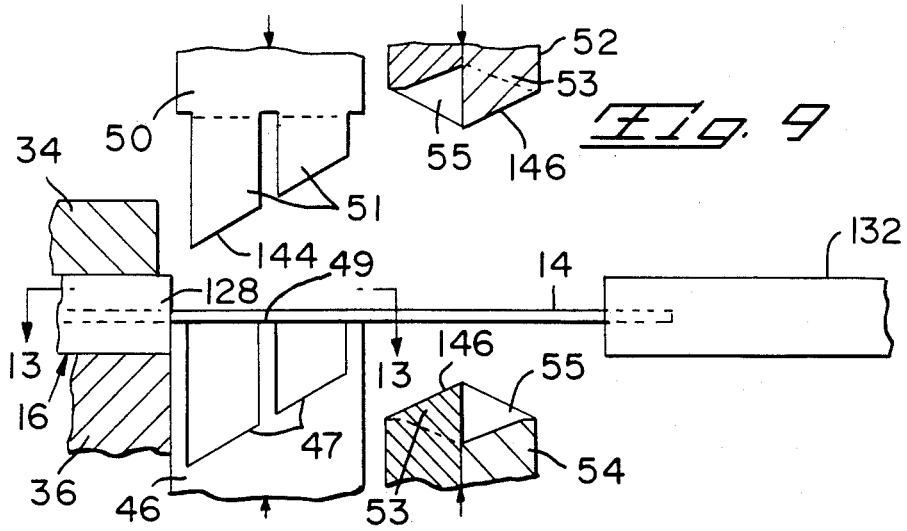
FIG. 9 is a fragmentary diagrammatic view of the comb, support, and shear tooling prior to the comb and shear tooling making contact with a conductor.
Figure 13:
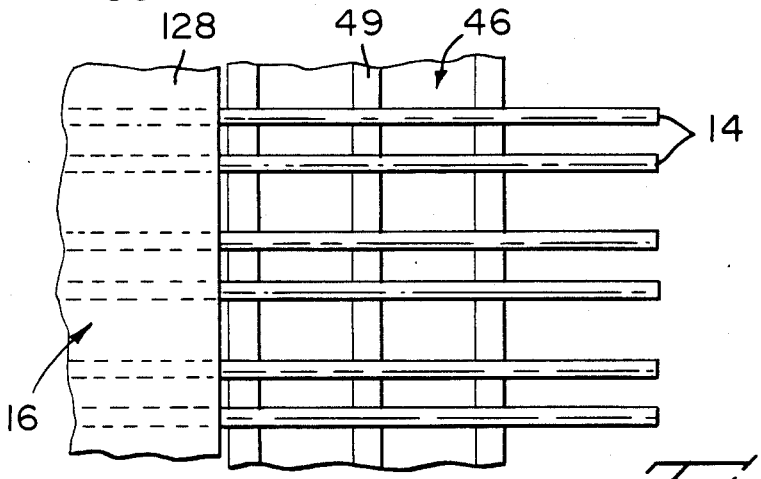

FIG. 13 is a cross-sectional view of the individual conductors of the ribbon cable prior to being combed taken along line 13—13 of FIG. 9.

Figure 10:
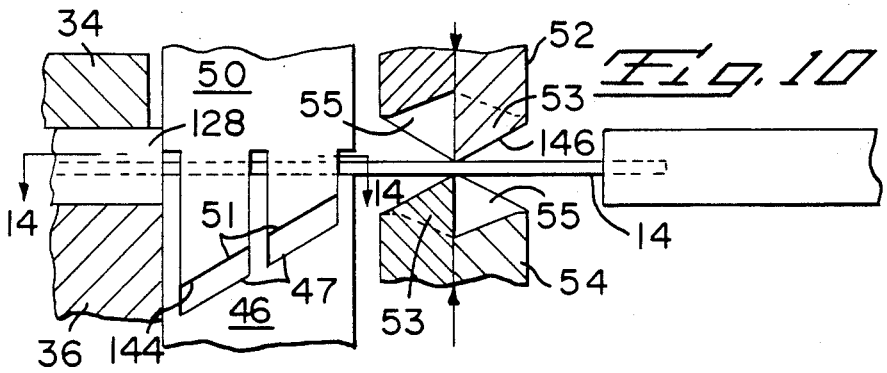
FIG. 10 is a view similar to that of FIG. 9 showing the comb, support, and shear tooling in engagement with the conductor.
Figure 14:
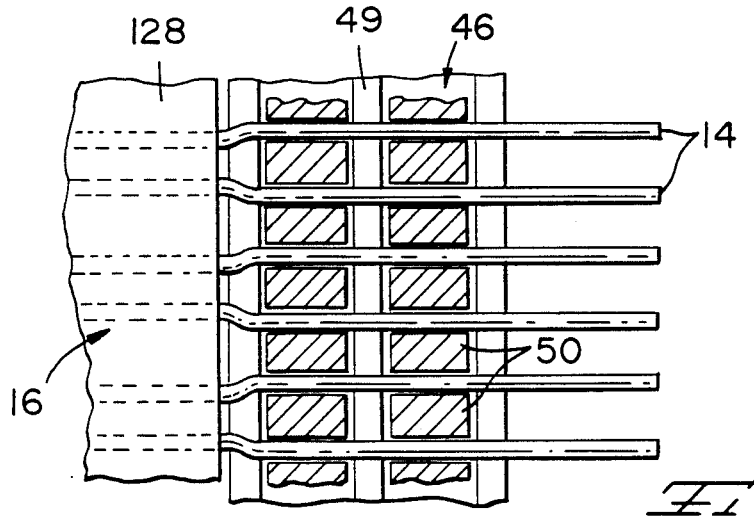

FIG. 14 is a cross-sectional view taken along line 14—14 of FIG. 10 showing the individual conductors after combing.

Figure 15:
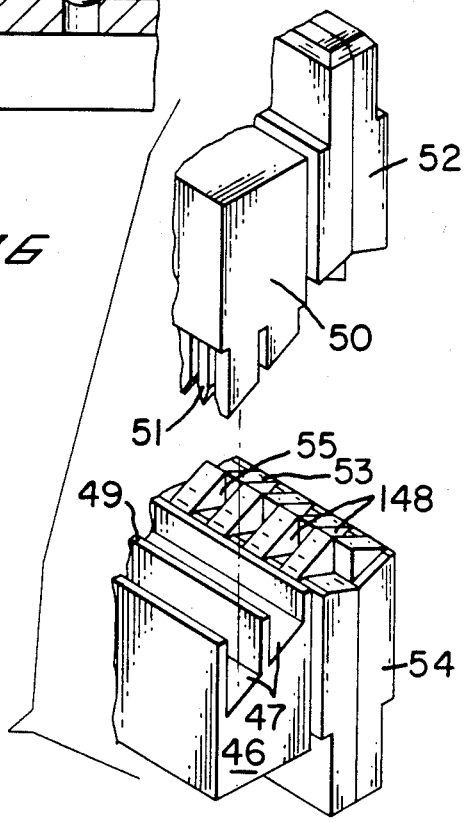

FIG. 15 is a perspective fragmentary view of the support member and a portion of the shear tooling, showing the staggered positioning of the shear blades.

Figure 16:
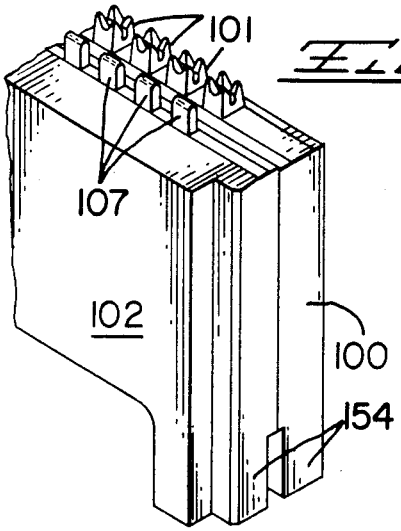

FIG. 16 is a perspective fragmentary view of the insertion and crimp tooling.

Figure 17:
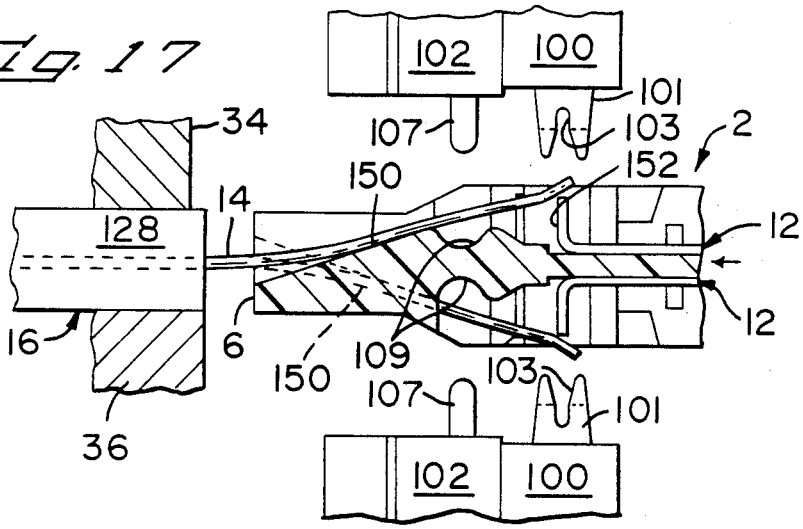

FIG. 17 is a fragmentary diagrammatic view of the insertion-crimp tooling with respect to the connector as the connector is brought into engagement with the conductor.

Figure 18:
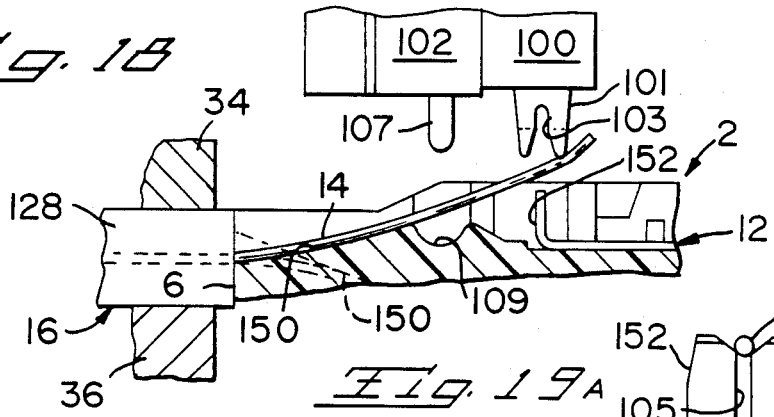

FIG. 18 is a view similar to that of FIG. 17 showing details of only a single side of the tooling, connector, and conductor after the second position has been reached.

Figure 19A:
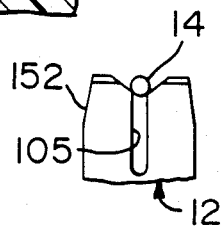
Figure 19:
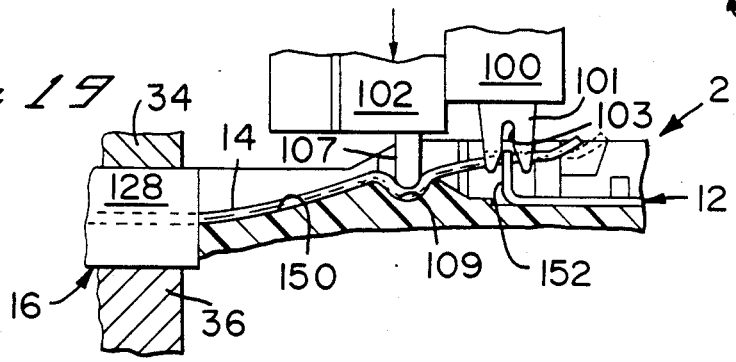

FIG. 19 is a view similar to that of FIG. 18 showing the insertion tooling in a first stop position and the crimp tooling in a fully inserted position.

FIG. 19*a* is a cross-sectional view of the conductor in engagement with the terminal of the connector as the insertion tooling is in the first position.

FIG. 20 is a view similar to that of FIG. 18, with the exception that the entire connector is shown, depicting the crimp and insertion tooling in a fully inserted position.

DETAILED DESCRIPTION OF THE INVENTION

An electrical connector 2 of the type described in U.S. patent application Ser. No. 565,510 filed Dec. 27, 1983 and now abandoned, the description of which is incorporated herein by reference, comprises an insulating housing 4 having a first end 6 and a second end 8. Housing 4 is formed with rows of cavities 10 on either side of housing 4, each cavity 10 accommodating an electrical terminal 12 therein for termination of individual conductors 14 of a ribbon cable 16 thereto.

Termination apparatus 18 of the present invention terminates individual conductors 14 of ribbon cable 16 to respective terminals of connector 2. In order for this to be accomplished, the tooling of apparatus 18 must work on individual conductors 14 to prepare conductors 14 for proper termination. The various functions performed by apparatus 18 on conductors 14 will be discussed below. It should be noted that the termination apparatus to be described herein is intended, according to an exemplary mode of use, to perform operations which are illustrated diagrammatically in FIGS. 9 through 20.

Figure 1:
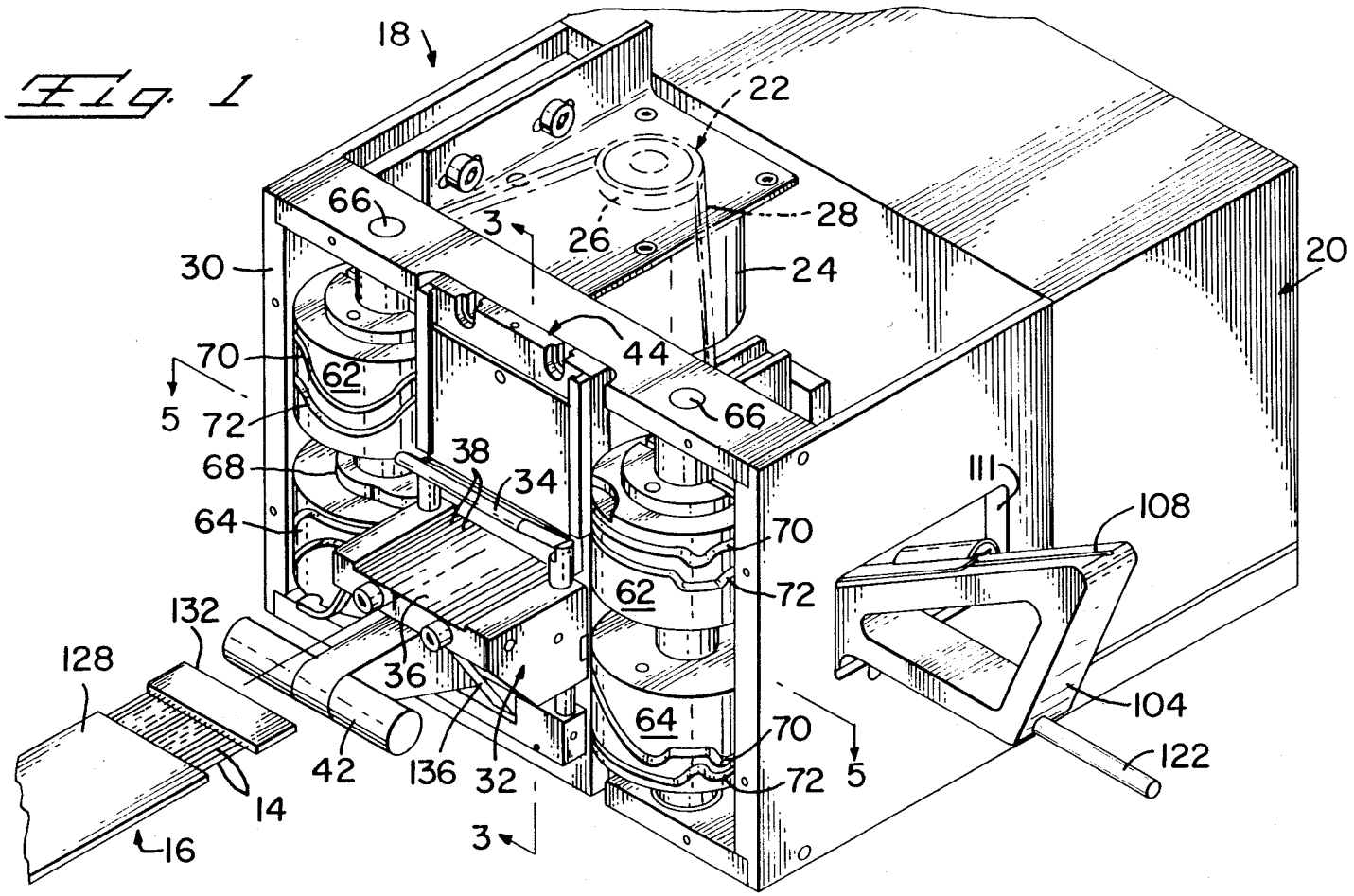
FIG. 1 is a perspective view of an apparatus of the present invention, showing the corresponding ribbon cable before insertion therein.
Figure 2D:
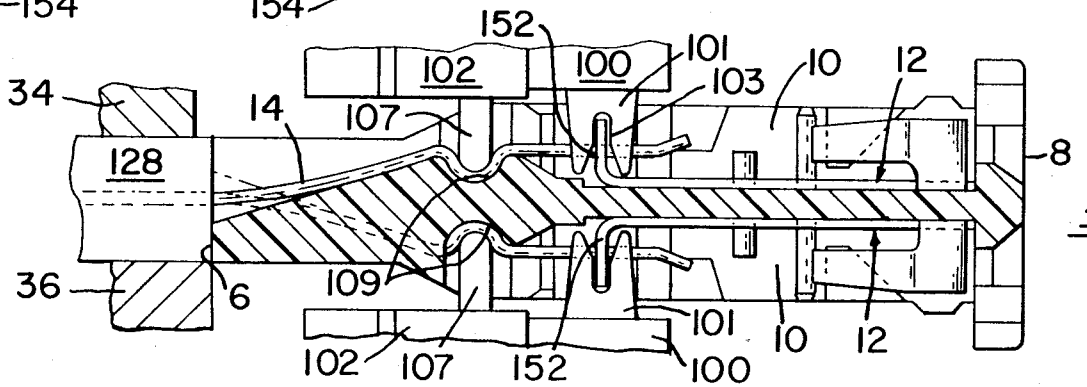
FIG. 2 is a rear perspective view of the apparatus.

Before the operation of apparatus 18 is described, a brief description of the various subassemblies will be undertaken. As shown in FIGS. 1 and 2, termination apparatus 18 is comprised of various subassemblies. An electrical subassembly 20, present in the back section of apparatus 18 but not shown in any detail, is provided to supply the power and controls needed for the remaining subassemblies. The components used in electrical subassembly 20 are of the type commonly used and therefore no details of this portion of apparatus 18 need be discussed.

Power train subassembly 22 cooperates with electrical subassembly 20 such that when the appropriate controls are engaged, power train 22 converts the electrical impulses into mechanical motion, causing the various other subassemblies to move accordingly. Power train 22 is of the standard type and includes a motor 24, a drive sprocket 26, and a chain 28.

Power train 22 and electrical subassembly 20 are confined inside frame 30 of apparatus 18. Frame 30 ensures that the various subassemblies are in proper position relative to each other as well as protecting the various subassemblies from harm caused by external forces.

Figure 3:
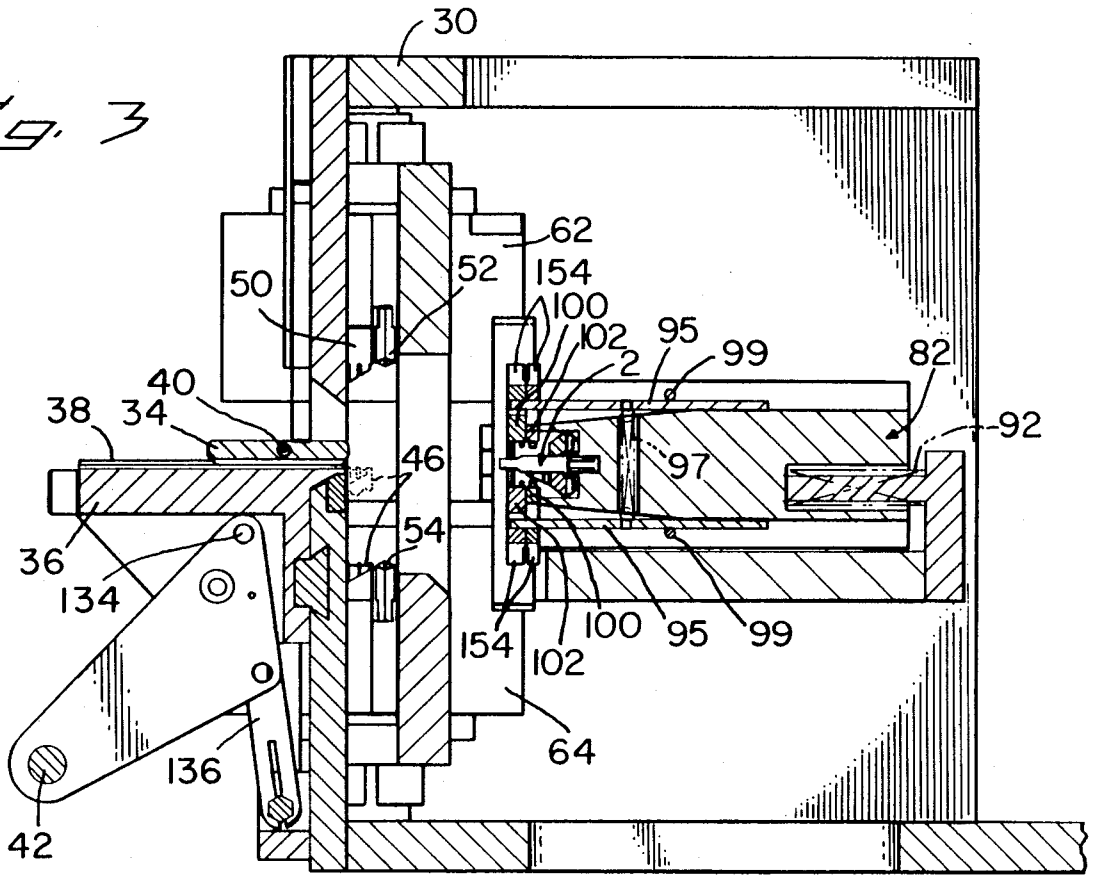
FIG. 3 is a cross-sectional view of the apparatus taken along line 3—3 of FIG. 1 showing a shuttle subassembly in the first or back position.

Connected to frame 30 and extending outward therefrom is a clamp 32. Clamp 32 is positioned on a front side of frame 30, opposite the portion of frame 30 which is enclosed by electrical subassembly 20. FIG. 1 shows clamp 32 in the open position. In this position, a top plate 34 of clamp 32 is positioned approximately forty-five degrees relative to a top surface 36 of a cable registry 38. It should be noted that top plate 34 is also positioned approximately forty-five degrees from the plane of the front side of frame 30. Pivot 40 cooperates with a spring to maintain top plate 34 in position until handle 42 of clamp 32 is engaged. The closed position of clamp 32, shown in FIG. 3, is defined by top plate 34 being essentially perpendicular to top surface 36 of cable registry 38. In this position, a gap remains between top plate 34 and top surface 36 in order to permit ribbon cable 16 to be secured in place, as will be discussed.

Clamp 32 is adjacent comb-shear subassembly 44. A support member 46 of comb-shear tooling 44 cooperates with ribbon cable 16 to ensure proper position of ribbon cable 16 during insertion of ribbon cable 16 onto clamp 32. The width of the opening 48 of comb-shear tooling 44 corresponds to the width of clamp 32. Tooling 44 comprises support member 46, a comb 50, and two shearing members 52, 54. The tooling is held in place by frame 30, as shown in FIG. 1. Tooling 44 also includes a sliding door 56 and tracks 58, door 56 cooperating with clamp 32 to permit insertion of ribbon cable 16 into apparatus 18.

Support member 46 and comb 50 are aligned in a first plane which is parallel to the plane of the front side of frame 30. Shearing members 52, 54 are aligned in a second plane which is adjacent the first plane and parallel thereto. Support member 46 has recesses 47 which align with blades 51 of comb 50 such that as comb 50 is brought into engagement with support member 46, as will be discussed, blades 51 are inserted into recesses 47. As is shown in FIG. 12*a*, blades 51 and recesses 47 are not continuous but are in two rows, allowing conductors 14 to be better supported as an extra support surface 49 is provided on support member 46. Shearing members 52, 54 have staggered teeth 53 as best shown in FIG. 15. Adjacent each tooth 53 is a recess 55. Members 52, 54 align in such a way so that as shearing members 52, 54 are brought together, teeth 53 of one member will align with recesses 55 of the other member.

Positioned on either side of support member 46, comb 50, and shearing members 52, 54 are cam followers 60, shown in FIG. 6. Cam followers 60 cooperate with four barrel cams 62, 64, as shown in FIG. 1. Two barrel cams 62, 64 are provided on either side of the comb-shear subassembly 44. Barrel cams 62, 64 are rotationally mounted to frame 30 by shafts 66. Also mounted on one of the shafts 66 on barrel cam 64 is a secondary cam 68. Each barrel cam 62, 64 has cam tracks 70, 72 which cooperate with the cam followers 60 to move the tooling of comb-shear subassembly 44. An arm 74 extending from clamp 32 also cooperates with a respective cam recess 78 to automatically disengage clamp 32 from ribbon cable 16 when the required functions have been performed. Arcuate end 76 of arm 74 bears against barrel cam 64 until arcuate end 76 contacts enlarged recess 78 allowing arm 74 to move inward, causing clamp 32 to spring to the open position.

Figure 5:
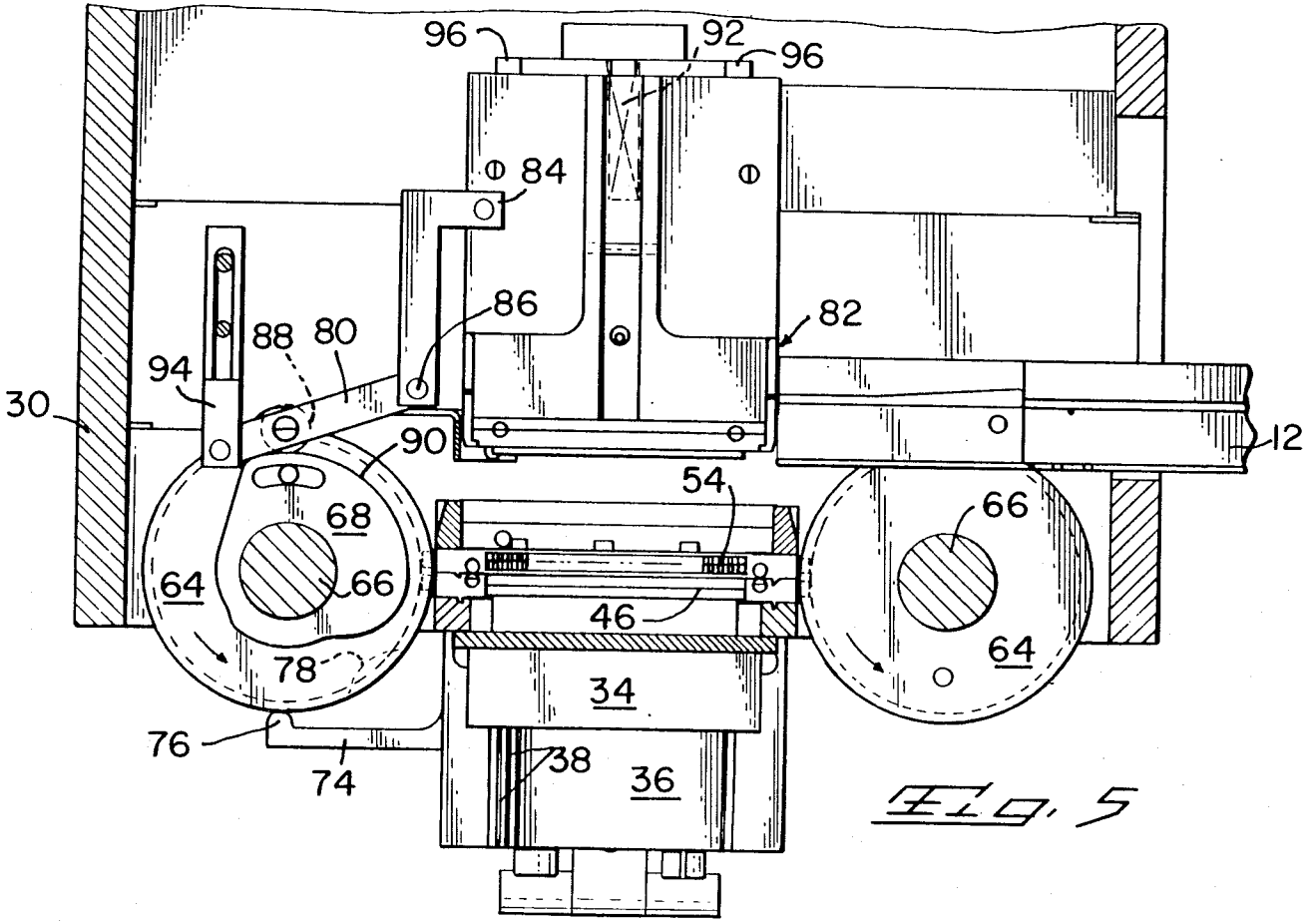
FIG. 5 is a cross-sectional view of the apparatus taken along line 5—5 of FIG. 1.

An arm 80 is provided between secondary cam 68 and an insertion-crimp subassembly or shuttle 82, as shown in FIG. 5. End 84 of arm 80 is pivotally mounted to shuttle 82. A second pivot 86 is provided at an intermediate portion of arm 80. These pivots allow arm 80 to exert force on shuttle 82. Cam follower 88, attached to arm 80, follows surface 90 of secondary cam 68, causing arm 80 and shuttle 82 to move accordingly.

Bracket 94 of arm 80 is a fixed pivot point for arm 80, allowing arm 80 to move shuttle 82 as required. Bracket 94 can be adjusted to obtain the proper positioning such that arm 80 will move shuttle 82 between the appropriate front and back position.

Figure 4:
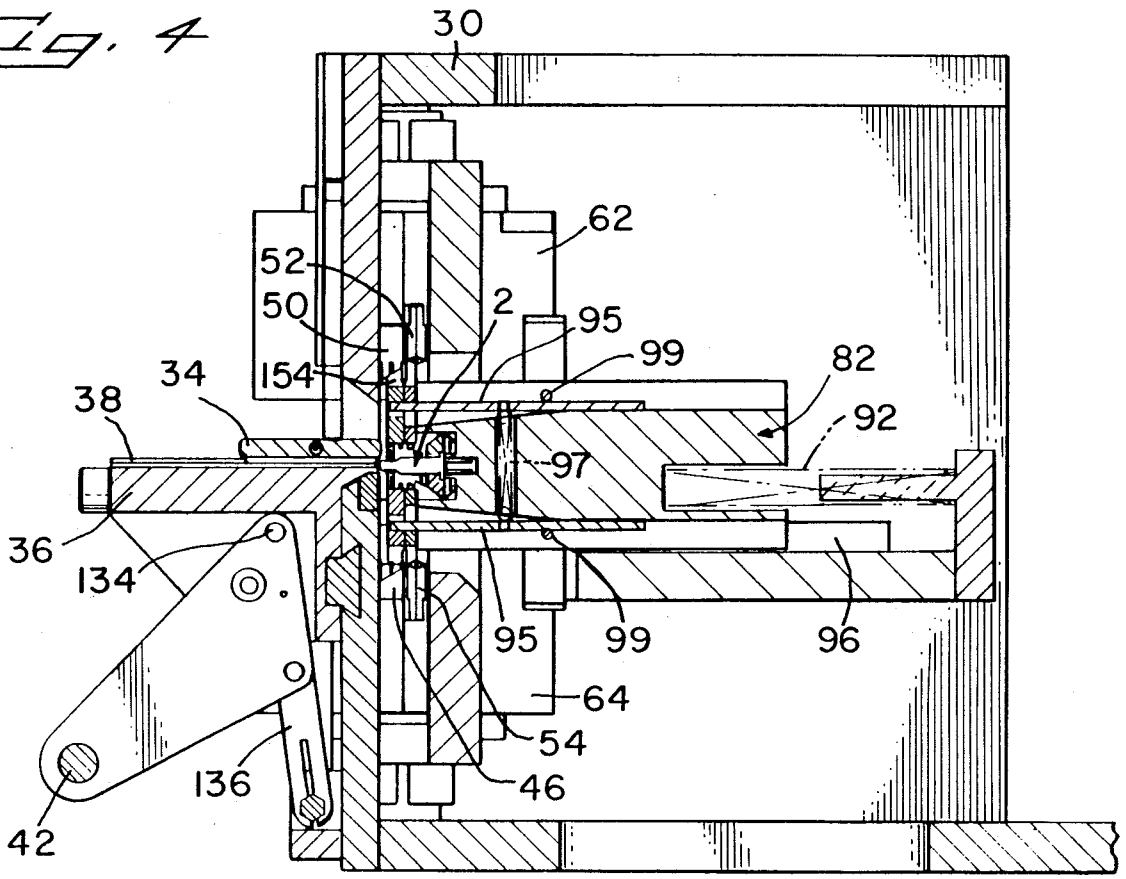
FIG. 4 is a view similar to that of FIG. 3 except the shuttle is in the second or forward position.

Shuttle 82 is slidably mounted on a cross roller member 96, as best shown in FIG. 2 or 4. This allows shuttle 82 to move forward and backward as required. To assist this movement, shuttle 82 has spring 92 attached to a rear portion thereof. Shuttle 82 positions connector 2 in the proper position for termination to ribbon cable 16. Shuttle 82 also contains insertion tooling 100, 102. Insertion tooling 100 has a four-pronged member 101, as best shown in FIG. 15. Slots 103 of member 101 cooperate with conductors 14 to insert conductors 14 into corresponding slots 105 (FIG. 19*a*) of terminating sections 152 of terminals 12 of connector 2. Crimp tooling 102 has a post member 107 projecting therefrom. Post member 107 has an arcuate end which cooperates with conductors 14 and recesses 109 of connector 2. Insertion and crimp tooling 100, 102 cooperate with comb-shear tooling 44 when shuttle 82 is in a forward position to provide the required motion. Levers 95 are connected to tooling 100, 102 at one end, to spring 97 at a midsection, and a pivot 99 at the other end. This enables tooling 100, 102 to be resiliently restored to their original position as required.

Figure 8:
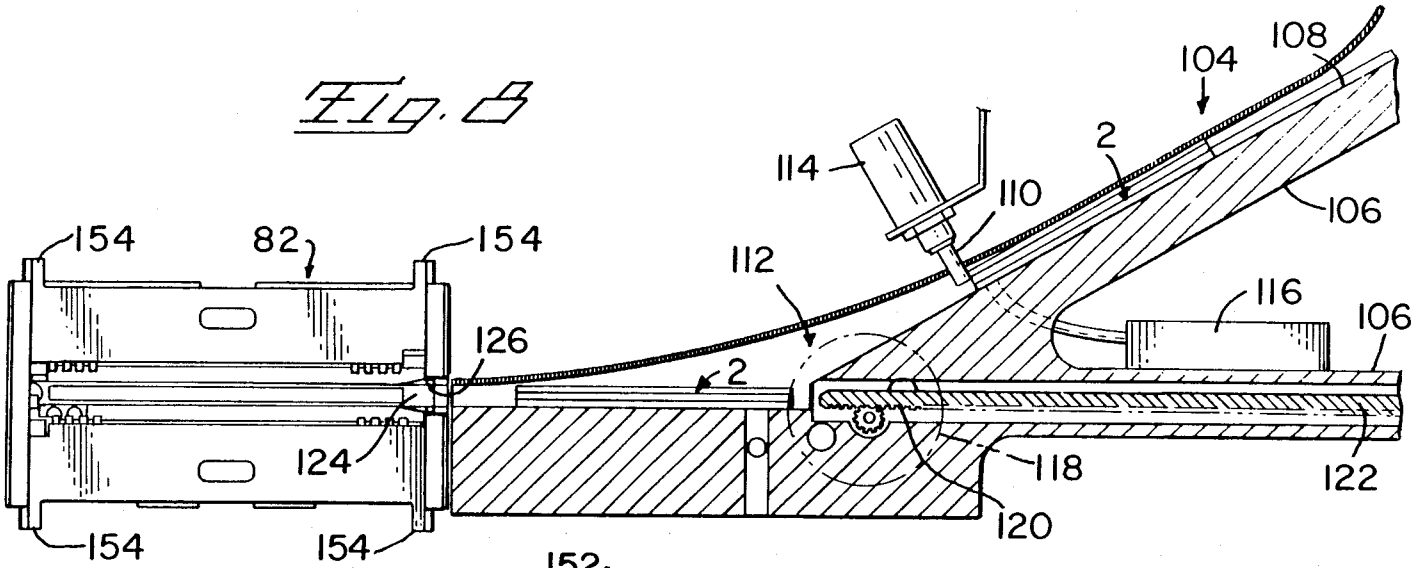
FIG. 8 is a cross-sectional fragmentary view of the feed subassembly and the shuttle showing a connector as it is inserted into the shuttle.

A feed subassembly or feed track 104 is provided to automatically provide connectors 2 to apparatus 18 as needed. Feed track 104 extends beyond the confines of frame 30, as shown in FIGS. 1 and 2, through opening 111. Feed track 104 depicted in FIG. 8 comprises a triangular body portion 106, a top leg of which is the actual surface 108 on which connectors 2 are moved. A small pin 110 prevents connectors 2 from moving into a loading zone 112 until the appropriate time. At the appropriate time, a solenoid 114 drives pin 110 away from surface 108, leaving enough clearance for connector 2 to slide through. An optical sensor 116 times the rise and fall of pin 110 according to the size of connector 2 to be worked on. Consequently, various size connectors 2 can be terminated in apparatus 18 according to the size of ribbon cable 16 being used. As connector 2 is allowed to pass pin 110, connector 2 falls into loading zone 112. A motor 118 turns engaging teeth 120 of a cylindrical rod 122, causing rod 122 to move towards shuttle 82. This causes connector 2 to be fed into shuttle 82. As can be seen in FIG. 8, shuttle 82 has a wide insertion zone 124 which has walls 126 acting as lead-ins. Walls 126 taper inward, allowing connector 2 to be out of position when fed into the shuttle 82 without adversely affecting the operation of apparatus 18.

It should be noted that many different types of clamps 32 and feed tracks 104 may be used to produce the desired results. The description of the foregoing is intended merely as one such alternative.

Before going onto a detailed description of how the tooling of apparatus 18 operates, an overview of the operation of the entire apparatus is as follows:

Ribbon cable 16 is inserted into clamp 32. As is shown in FIG. 1, ribbon cable 16 has a section of exposed individual conductors 14. Adjacent each exposed portion is a dielectric jacket 128 of ribbon cable 16. This allows individual conductors 14 to be worked on as will be more fully discussed below. Proper insertion of ribbon cable 16 occurs as cable 16 contacts cable guide 130 of cable registry 38, aligning cable 16 in the proper left-right position. Proper insertion depth of cable 16 occurs when leading edge 132 of cable 16 contacts support member 46 of comb-shear subassembly 44. To ensure that this contact is made, support member 46 is raised from the plane of top surface 36 of cable registry 38, enabling leading edge 132 of cable 16 to contact support member 46 as the insertion process is performed. Once proper position of cable 16 is ensured, handle 42 of clamp 32 is lowered, causing handle 42 to pivot about pivot point 134. This pivoting motion causes toggle 136 to open, pushing rods 137 downward, causing top plate 34 to close on top of ribbon cable 16. Pivot 40 cooperates with top plate 34 to allow top plate 34 to move from the forty-five degree open position to the closed position which is parallel to surface 36 of cable registry 38. This ensures that ribbon cable 16 will be positioned in grooves of the cable registry 38 and against the support 46. Ribbon cable 16 is now secured from movement. However, as the end of the cable 16 is positioned past clamp 32, minimal movement of the end of cable 16 can occur, as will be discussed. It should be noted that clamp 32 can be moved left or right to accommodate left- and right-hand connectors.

With cable 16 clamped by clamp 32, the automatic process of terminating cable 16 to connector 2 is begun. Comb 50 comes down to make contact with individual conductors 14 and support member 46. This is followed by shearing members 52, 54 engaging conductors 14 from either side. Shearing members 52, 54 are then retracted leaving comb 50 in contact with individual conductors 14 of ribbon cable 16 and with support member 46. As shearing members 52, 54 are retracted, shuttle 82 is brought forward. As barrel cams 62, 64 rotate, cam follower 88 of arm 80 moves along cam surface 90 of secondary cam 68, causing shuttle 82 to move accordingly. The shape of cam surface 90 allows shuttle 82 to move forward as shearing members 52, 54 are retracted. Shuttle 82 remains in a stable position once connector 2 has contacted the ends of individual conductors 14 due to cam surface 90 of secondary cam 68 being flat, thereby translating no motion to shuttle 82. This allows comb 50 and support member 46 to be removed from conductors 14 as connector 2 maintains conductors 14 in proper position. Once comb 50 and support member 46 are completely retracted, cam surface 90 again allows shuttle 82 to move. This continues until shuttle 82 reaches the forward position, at which time shuttle 82 again remains stable for a period of time. This movement of comb 50, support member 46, shearing members 52, 54, and shuttle 82 is coordinated by the accuracy of the cam tracks 70, 72 and cam surface 90. In other words, cam tracks 70, 72 and cam surface 90 act as a timing means to enable the desired function to be performed at the exact time required.

When shuttle 82 is in the forward position, insertion tooling 100 and crimp tooling 102 are nestled between comb 50, support member 46, and shearing members 52, 54. Consequently, as comb 50, support member 46, and shearing members 52, 54 are taken through a secondary rise and fall, comb 50, support member 46, and shearing members 52, 54 cooperate with insertion and crimp tooling 100, 102 to cause insertion and crimp tooling 100, 102 to be driven toward conductors 14 performing their respective functions. As comb 50, support member 46, and shearing members 52, 54 retract, insertion and crimp tooling 100, 102 are resiliently returned to the open positions by spring 97 connected to levers 95. As tooling 100, 102 is driven, spring 97 is stressed. Consequently, as the driving force is removed, springs 97 attached to levers 95 return to the unstressed position, causing insertion and crimp tooling 100, 102 to return to the open position.

Figure 7:
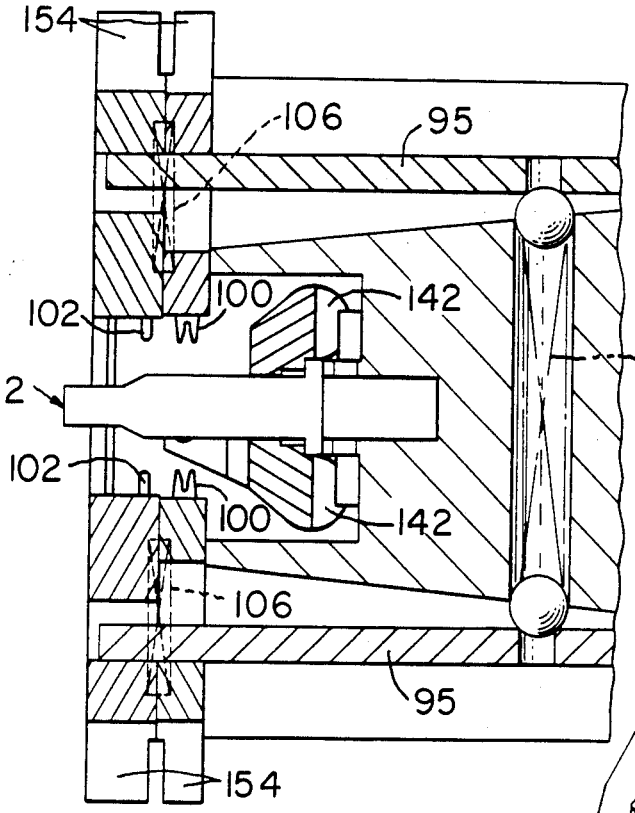
FIG. 7 is an enlarged cross-sectional view of the shuttle showing the insertion-crimp tooling positioned adjacent the connector.

With termination of ribbon cable 16 complete, shuttle 82 is returned to the first or back position. As this occurs, a connector release 142 of shuttle 82 permits connector 2 to pop out of shuttle 82 as shuttle 82 is returned. This is necessary as connector 2 is attached to ribbon cable 16. Connector release 142, as best shown in FIG. 7, is a spring mechanism which rotates, allowing connector 2 to disengage from release 142 as the appropriate forces are applied. As connector release 142 clears connector 2, it is resiliently returned to its unstressed position. After shuttle 82 is returned to the back position, clamp 32 automatically releases ribbon cable 16, allowing ribbon cable 16 and attached connector 2 to be removed from assembly 18.

At the same time, feed assembly 104 loads a next connector 2 into release 142 through cable guide 130 of shuttle 82. When shuttle 82 reaches the back position, all parts of apparatus 18 are returned to their original position, ready for the next termination to occur.

With the overview of apparatus 18 complete, it is important that the operation of the tooling be described in detail.

Ribbon cable 16 is positioned in claim 32, which is closed thereby securing cable 16 in place, as was earlier discussed. The process of terminating connector 2 onto ribbon cable 16 is begun when a button (not shown) is depressed to start the electronic controls of apparatus 18.

As the process of terminating connector 2 to cable 16 occurs, comb 50, support member 46, and shearing members 52, 54 are operated, performing their respective functions on individual conductors 14 of ribbon cable 16. With cable 16 in the proper position, comb 50, support member 46, and shearing members 52, 54 will cooperate with the exposed portion individual conductors 14. As shown in FIGS. 5 and 6, the comb-shear tooling 44 has cam followers 60 located on either side of tooling 44. Each member 50, 46, 52, 54 of tooling 44 has a respective cam follower 60 on either side, each cam follower cooperating with a respective barrel cam. Consequently, eight cam followers 60 are provided on comb 50, support member 46, and shearing members 52, 54, each of which cooperates with respective tracks 70, 72 of the appropriate barrel cams 62, 64.

With individual conductors 14 supported by clamp 32, comb 50 is brought toward conductors 14 and engaging with individual conductors 14 and support member 46. This engagement with comb 50 deflects conductors 14, spacing them as shown in FIG. 14. Comb 50 is angled to provide longitudinal comb action from a lateral motion of comb 50. Leading edge 144 of comb 50 engages conductors 14 at the point where they exit from dielectric jacket 128. Leading edge 144 is sloped such that as the downward motion of comb 50 is continued, the remaining portion of comb 50 engages individual conductors 14, spacing them accordingly. This type of configuration is important because individual exposed conductors stand a good chance of being randomly displaced due to some outside force, making it nearly impossible for comb 50 to contact and space each individual conductor 14. However, the portion of the exposed conductors which is adjacent dielectric jacket 128 is not very easily displaced. Consequently, as comb 50 is brought into engagement with conductors 14, comb 50 first makes engagement with the portion of the conductors which is relatively stable. As the motion continues, comb 50 straightens out conductors 14, spacing them accordingly. Therefore, the configuration of comb 50 allows for maximum wire control as combing occurs. As comb 50 moves toward conductors 14, blades 51 cooperate with recesses 47 of support member 46 to provide an interlocking action so that conductors 14 are not stressed as further operation occurs.

As discussed, cam followers 60 cooperate with cam tracks 70, 72 located on barrel cams 62, 64 such that as barrel cams 62, 64 turn, cam followers 60 cause comb 50 to move accordingly. All movements of comb 50, support member 46, and shearing members 52, 54 are brought about by the respective cam followers 60 following a respective track 70, 72 of rotating barrel cam 62, 64.

Figure 11:
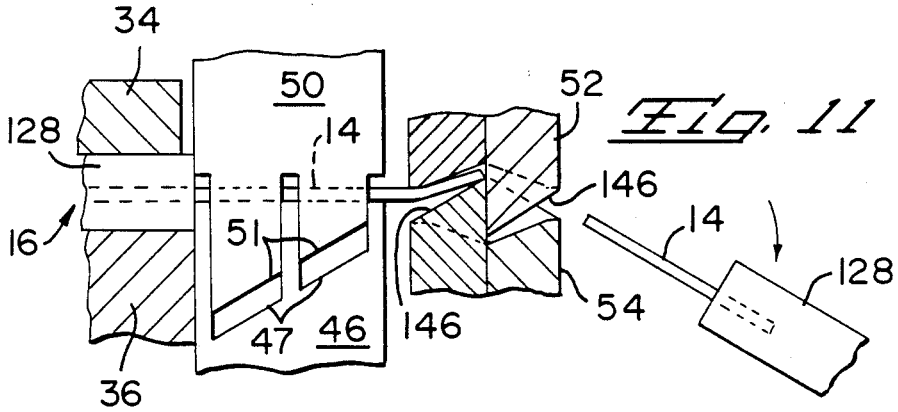
FIG. 11 is a view similar to that of FIG. 9 showing the conductor being sheared and formed by the shear tooling.
Figure 12:
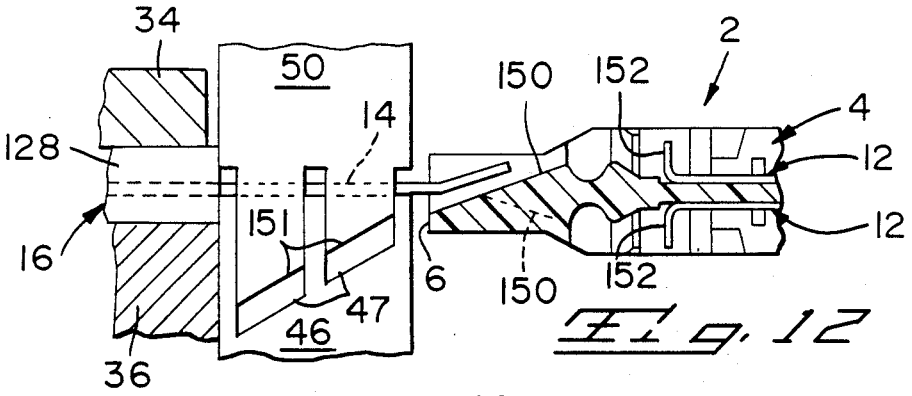
FIG. 12 is a view similar to that of FIG. 9 showing the shear tooling retracted and the connector being brought into engagement with the conductor.

A short time after comb 50 is started in motion, shearing members 52, 54 are also placed in motion. This staggered starting allows comb 50 to space individual conductors 14 in the required position before shearing blades 146 of teeth 53 of shearing members 52, 54 engage the individual conductors. Shearing blades 146 do not engage individual conductors 14 until the combing action has taken place. Blades 146 engage conductors 14, shearing conductors 14 to the proper length. Shearing blades 146 continue past the plane of conductors 14 until blades 146 are overlapped as shown in FIG. 11. This overlapping of blades 146 preforms individual conductors 14 of ribbon cable 16 into the position required. The staggering of teeth 53 and recesses 55 allow this overlapping to occur. The staggering also alternates the preforming of conductors 14 such that the bend of conductors 14 alternate up and down, providing the proper conductor orientation and configuration for termination to terminals 12 of connector 2.

It is important to the smooth performance of this invention that individual conductors 14 be preformed. The bending of individual conductors 14, as shown in FIGS. 17 and 18, allows terminating ends of terminals 12 of connector 2 to be brought into contact with ends of individual conductors 14 with minimal difficulty. Each conductor 14 is formed such that every second conductor is bent upward with the remaining conductors being bent downward. The bend of conductors 14 cooperates with tapered surfaces 150 of conductor-receiving passages of housing 4 of connector 2 such that the bend slides along surfaces 150. Tapered surfaces 150 are tapered up or down corresponding to the bend of the respective conductor with which it cooperates. When conductors 14 encounter terminating ends 152 of terminals 12 of connector 2, the bend allows conductors 14 to be slid above ends 152, preventing conductors 14 from improper insertion. In other words, the bend of conductors 14 prevents conductors 14 from stubbing with ends 152. Stubbing in conductors that are not deformed is a common occurrence and results in any given conductor being deformed resulting in the conductor not making electrical contact with the connector. The bend allows easier insertion because the round surface cooperates with end 152 while a flat end of other conductors tends to dig into the wall.

When shearing and preforming are finished, shearing members 52, 54 are retracted, returning to the first or original position, ribbon cable 16 and individual conductors 14 being held in place by clamp 32 and by comb 50 in cooperation with support member 46.

Shuttle 82, with connector 2 in place, is moved forward by cam driven arm 80 as shearing members 52, 54 retract. Comb 50 and support member 46 remain in contact with conductors 14 until connector 2 is brought into engagement with conductors 14. This ensures that the proper spacing is maintained between the individual conductors at all times. Once conductors 14 are in engagement with connector 2, comb 50 is retracted, returning to its original position. At the same time, support member 46 moves, for the first time, to an open position. As this occurs, shuttle 82 is not moved but rather is maintained in position. As comb 50 and support member 46 are completely retracted, shuttle 82 is again moved forward. This forward motion is stopped as connector 2 engages jacket 128 of ribbon cable 16, thus defining a forward position. Shuttle 82 remains in this position until crimping and insertion are completed.

Insertion and crimp tooling 100, 102 is carried within shuttle 82. When shuttle 82 reaches its forward stop position, insertion and crimp tooling 100, 102 are nestled between retracted comb 50, support member 46, and shearing members 52, 54, as shown in FIG. 4.

With shuttle 82 in this forward position, barrel cams 62, 64 continue to turn, causing comb 50, support member 46, and shearing members 52, 54 to have a secondary rise and fall. This secondary rise and fall is similar to the first rise and fall in that comb 50 is moved first, with shearing members 52, 54 moving shortly thereafter. However, differences are present. In the secondary rise and fall, support member 46 is moved from an open position back to the open position. Also, comb 50, support member 46, and shearing members 52, 54 all retract at the same time in this secondary phase. Projections 154 of insertion and crimp tooling 100, 102 cooperate with comb 50, support member 46, and shearing members 52, 54 such that as comb 50, support member 46, and shearing members 52, 54 are moved toward individual conductors 14, insertion and crimp tooling 100, 102 move accordingly. This causes conductors 14 to be partially inserted into channels 105 crimped into recesses 109 and fully inserted into channels 105 as will be described. Projections 154 are positioned at ends of tooling 100, 102 to cooperate with comb 50, support member 46, and shearing members 52, 54 and not with the actual comb and shear surfaces, preventing the surfaces from being unnecessarily worn from engagement with upper surfaces of insertion and crimp tooling 100, 102.

Crimp tooling 102 is driven toward conductors 14. Crimp tooling 102 is engaged before insertion tooling 100 because crimp tooling 102 is positioned between comb 50 and support member 46, which during the secondary rise and fall are moved before shearing members 52, 54. Insertion tooling 100 follows, as insertion tooling 100 and crimp tooling are connected by spring 106. This continues until insertion tooling 100 engages conductors 14. At this stage, insertion tooling 100 applies enought pressure on conductors 14 to align conductors 14 in channels 105 as shown in FIGS. 19 and 19*a*. This pressure, however, causes spring 106 to deflect, causing crimp tooling 102 and insertion tooling 100 to act as independent members. Consequently, crimp tooling 102 continues downward, forcing conductors 14 into recesses 109 thereby deforming them as shown in FIG. 19. This deformation provides the strain relief necessary between cable 16 and connector 2 when covers are secured onto connector 2. As crimp tooling 102 completes the operation, the force applied to it is maintained, as comb 50 and support member 46 are held stationary. At the same time, a force is exerted on insertion tooling 100 by shearing members 52, 54 as they continue to move toward conductors 14. This movement of shearing members 52, 54 provides the required pressure to drive insertion tooling 100 toward conductors 14, resulting in conductors 14 being properly inserted into the channels 105 of the terminals of connector 2 according to standard insulation displacement methods.

As insertion of conductors 14 is completed, comb 50, support member 46, and shearing members 52, 54 are retracted, disengaging from insertion and crimp tooling 100, 102. Spring 97 resiliently forces insertion and crimp tooling 100, 102 back to the open position, as previously discussed. Consequently, insertion and crimp tooling 100, 102 are disengaged from connector 2 and conductors 14, clamp 32 retaining ribbon cable 16 and attached connector 2 in place.

Shuttle 82 is retracted while clamp 32 is closed. Connector release 142 allows connector 2 to pop out of shuttle 82, as connector 2 is terminated to ribbon cable 16. This feature allows lateral connector feed and longitudinal connector extraction from a passive mechanism. As shuttle 82 is retracting, support member 46 is moving toward cable 16 to assume its original position.

Once shuttle 82 has reached its original position, clamp 32 automatically releases ribbon cable 16 and connector 2. The release is timed after shuttle 82 has retracted but before support member 46 fully returns to its starting position. As clamp 32 pops open, the completed cable assembly, connector 2 attached to cable 16, is released from apparatus 18. Support member 46 returns to its original position after ribbon cable 16 is free so as not to damage the newly terminated connector.

At the same time, automatic feed assembly 104 feeds another connector into shuttle 82, placing apparatus 18 in its original position, ready to repeat the cycle as many times as required. As the process is repeated, all that the operator need do is to properly position the ribbon cable in the clamp, place connectors in the feed track, clamp the ribbon cable in position, hit the start button, and remove the cable assembly after all the automatic functions have been performed.

We claim:

1. An apparatus for terminating conductors of an electrical cable to terminating sections of electrical terminals disposed in a dielectric housing of an electrical connector having conductor receiving passages therein, the apparatus comprising:

clamp means to maintain the cable in proper position:

comb means which cooperate with the conductors of the cable such that as the comb means is moved between a first position and a second position, the comb means spaces the conductors of the cable;

shearing means which cooperate with the conductors such that as the shearing means is moved between a first and second position, conductors are sheared and ends of the conductors are preformed;

shearing blades are provided on the shearing means, the shearing blades shear the conductors as the shearing means is moved from the first position toward the second position, the shearing blades continue past the plane of the conductors until the second position is reached, thereby forming the conductors accordingly;

shuttle means having the connector located therein, the shuttle being movable between a front and a back position;

whereby as the shuttle is moved from the back position to the front position, the tapered surfaces of conductor receiving passages of the connector cooperate with the preformed ends of the conductors so as to position the ends of the conductors in alignment with terminating sections of the terminals of the connector for termination thereto.

2. An apparatus as recited in claim 1 wherein insertion means and crimping means are provided on the shuttle means, such that as the shuttle means is moved to the front position the insertion and crimping means are operated to insert the conductors into the terminals of the connector and to crimp the conductors into recesses provided on the surface of the connector.

3. An apparatus as recited in claim 1 wherein drive means is provided to operate the comb, shearing, and shuttle means at the appropriate time.

4. An apparatus as recited in claim 3 wherein the drive means has barrel cams with cam tracks and camming surfaces, the cam tracks and camming surfaces cooperating with cam followers of the comb, shearing, and shuttle means, the cam tracks and the camming surfaces are precisely configured to ensure that the movement of the parts of the apparatus is performed as required.

5. An apparatus as recited in claim 1 wherein feed means is provided to automatically feed the connectors into the shuttle means.

6. An apparatus as recited in claim 1 wherein the shearing blades of the shearing means are staggered so that as the shearing blades shear the conductors and continue past the plane of the conductors, the conductors are formed either up or down according to the respective staggered blade of the shearing member which contacts the conductor.

7. An apparatus as recited in claim 2 wherein the comb means and shearing means are taken through a primary and a secondary rise and fall, the primary rise and fall resulting in the comb means and the shearing means performing their respective functions on the conductors, the secondary rise and fall resulting in projections of the insertion and crimp means contacting the comb and shearing means, causing the insertion and crimp means to perform their respective functions on the conductors.

8. An apparatus as recited in claim 1 wherein the comb means is comprised of a support member and a comb member, the support member having recesses in which blades of the comb member are inserted, the blades having angled teeth which provide longitudinal spacing action from the lateral motion of comb 50.

9. An apparatus as recited in claim 1 wherein a resilient release mechanism is provided in the shuttle means so that after the conductors have been terminated to the connector, the shuttle means can be retracted from the front position to the back position, leaving the connector in the front position, attached to the conductors.

10. Apparatus for the termination of conductors of a ribbon cable to electrical terminals of a connector with the terminals being located on opposed sides thereof, the apparatus comprising:

a frame;

drive means mounted to the frame;

combing means provided adjacent the drive means, the combing means having spacing means located thereon, the spacing means space the conductors into proper parallel orientation;

shearing means adjacent the combing means, for shearing and preforming the spaced conductors such that ends of alternating conductors are formed in the same direction and ends of adjacent conductors are formed in an opposite direction;

shuttle means having insertion means and crimping means located thereon, the shuttle means having a connector receiving passage for receiving a connector therein;

whereby as the drive means is operated, the combing, shearing, and shuttle means cooperate with the drive means to coordinate the movement thereof so that as the connector is moved into engagement with the conductors, the formed ends of the conductors move easily along surfaces of the connector and into position for termination to the terminals of the connector while preventing stubbing of the conductors.

11. An apparatus as recited in claim 10 wherein feed means are provided to automatically feed the connectors into the shuttle.

12. An apparatus as recited in claim 10 wherein clamp means are provided to secure the ribbon cable in position.

13. An apparatus as recited in claim 10 wherein the drive means has barrel cams with cam tracks and camming surfaces, the cam tracks and camming surfaces cooperating with cam followers of the comb, shearing, and shuttle means, the cam tracks and the camming surfaces are precisely configured to ensure that the movement of the parts of the apparatus is performed as required.

14. An apparatus as recited in claim 10 wherein the comb means and shearing means are taken through a primary and a secondary rise and fall, the primary rise and fall resulting in the comb means and the shearing means performing their respective functions on the conductors, the secondary rise and fall resulting in projections of the insertion and crimp means contacting the comb and shearing means, causing the insertion and crimp means to perform their respective functions on the conductors.

15. An apparatus as recited in claim 10 wherein the comb means is comprised of a support member and a comb member, the support member having recesses in which blades of the comb member are inserted, the blades having angled teeth which provide longitudinal spacing action from the lateral motion of comb 50.

16. An apparatus as recited in claim 10 wherein a resilient release mechanism is provided in the shuttle means so that after the conductors have been terminated to the connector, the shuttle means can be retracted from the front position to the back position, leaving the connector in the front position, attached to the conductors.

17. An apparatus as recited in claim 10 wherein the shearing means has shearing blades, the shearing blades are staggered such that alternating conductors are sheared in the same direction and ends of adjacent conductors are sheared in the opposite direction.

18. An apparatus as recited in claim 17 wherein the shearing blades shear the individual conductors and continue past the plane of the conductors so that alternating conductors are formed in the same direction and ends of adjacent conductors are formed in an opposite direction.

* * * * *